US007513494B2

(12) United States Patent
Steinhilber et al.

(10) Patent No.: US 7,513,494 B2
(45) Date of Patent: Apr. 7, 2009

(54) METHOD AND DEVICE FOR SELECTING THE SHEETS OF A RECORD CARRIER FROM A PILE

(76) Inventors: Helmut Steinhilber, Sonnenberg Strasse 40, CH-6052 Hergiswil (CH); Ludwig Bantle, Wiesen Strasse 40, D-78662 Herrenzimmern (DE); Heinz Froechte, Beethoven Strasse 6, D-78658 Zimmern (DE)

( * ) Notice: Subject to any disclaimer, the term of this patent is extended or adjusted under 35 U.S.C. 154(b) by 820 days.

(21) Appl. No.: 10/734,442

(22) Filed: Dec. 12, 2003

(65) Prior Publication Data

US 2004/0141047 A1 Jul. 22, 2004

(30) Foreign Application Priority Data

Dec. 12, 2002 (DE) ..... 102 58 038

(51) Int. Cl.
*B65H 3/24* (2006.01)

(52) U.S. Cl. ..... 271/42; 271/34

(58) Field of Classification Search ..... 271/113, 271/110, 37, 38, 126, 121, 34, 169, 167, 271/10.08, 10.07, 220, 122, 42; 348/216
See application file for complete search history.

(56) References Cited

U.S. PATENT DOCUMENTS 4,579,329 A * 4/1986 Frost et al. ..... 271/10.14
5,730,439 A * 3/1998 Salomon ..... 271/122

FOREIGN PATENT DOCUMENTS

| | | | |
|---|---|---|---|
| DE | 1147 242 | | 4/1963 |
| DE | 100 16 793 | A1 | 10/2001 |
| JP | 62240237 | | 10/1987 |
| JP | 04333442 | A * | 11/1992 |
| JP | 11029232 | A * | 2/1999 |

* cited by examiner

*Primary Examiner*—Kaitlin S Joerger
(74) *Attorney, Agent, or Firm*—Baker Botts L.L.P.

(57) ABSTRACT

For the separation of the sheets of a record carrier from a pile (10) in order to feed them to an office machine or a printer, a rolling action device (14) sits on the uppermost sheet (12) of the pile (10). By means of the rolling action device (14), the uppermost sheet (12) is loosened from the following next sheet (20) and is pushed against a stop in the feeding direction. The stop is positioned at an impingement angle of at least 90 degrees in relation to the plane, in which the uppermost sheet (12) is being pushed against the stop. Then the stop is moved upwards so that it could pick upwards the front edge of the uppermost sheet (12). The stop can be built, for instance, of at least one upwards-running belt (22).

13 Claims, 9 Drawing Sheets

METHOD AND DEVICE FOR SELECTING THE SHEETS OF A RECORD CARRIER FROM A PILE

PRIORITY

This application claims foreign priority of the German application DE 10258038.3 filed on Dec. 12, 2002.

TECHNICAL FIELD OF THE INVENTION

The invention is about a method and a device for selecting the sheets of a record carrier from a pile in order to feed them to an office machine or a printer.

BACKGROUND OF THE INVENTION

In the office machines as printers, copy machines and other similar to them as well as in the printing presses, the record carriers in a sheet form are most often kept in stock in a pile. Then every uppermost sheet of the pile is selected and fed into the office machine. The selection, or the separation of the uppermost sheet, from the next sheet in the pile is a technically difficult problem, especially in the case of sheets of paper because they stick to each other in the pile. The clinging of the sheets is affected by adhesion, electrostatic discharge, friction, and other similar agents and depends on a great number of factors as, for instance, the thickness of the sheet, the stiffness of the sheet, the texture of the surface of the sheet, the humidity of the air, etc.

It is known from DE 44 44 836 A1 and DE 100 16 793 A1, that a rolling action should be applied to the uppermost sheet of the pile in order to loosen the uppermost sheet and to move it in the direction of the feeding. In the process of this rolling, rolling elements, for example, turning rollers are moved over the uppermost sheet exerting pressure over the pile in the direction of the movement of the sheet. In this way the uppermost sheets of the pile are deformed by this rolling action, whereas the deformation of the uppermost sheet is greatest. By means of this deformation, air can penetrate between the uppermost sheet and the following second sheet in such a way that the uppermost sheet can be loosened from the second sheet. By means of the pressure that the rolling elements exercise over the pile, a buckle in the upper sheets is formed in front of the rolling elements, which runs before the rolling element, whereby the rolling element exerts a feeding force onto the uppermost sheet in the direction of the feeding. In this way, the upper sheets of the pile are fanned out in the form of scales, or, respectively shingles, in the direction of the feeding.

The separation of the sheets using a rolling element has in particular the advantage that the separation takes place to a considerable extent independently of the properties of the sheets such as the thickness of the sheet, the stiffness of the sheet, the texture of the surface of the sheet, etc. The separation functions in a very reliable way, so that the undesirable pick-up of the second sheet of the pile can be excluded to a large extent. Since the separation does not depend very much on the quality of the sheets, this method of separation is suitable above all for such office machines, in which different sheet formats and sheet quality are stocked and selectively fed into the machine.

In the equipment that is known, the upper sheets of the pile are fanned out in the form of shingles by the effect of the rolling. As soon as the front edge of the uppermost sheet has been pushed at a sufficient distance from the front edge of the next, the second sheet, the uppermost sheet can be seized at its front edge and can be transported further. The fanning out of the upper sheets by means of the rolling action requires different times depending on the quality of the sheets.

Further, it is known that sheets from a pile can be selected in a way that a separation roller seizes by means of traction the uppermost sheet in the pile and then pushes it against a slanted ramp. Such devices are known, for instance, from EP 0534 245 A1, DE-PS 493 270, WO 89/03 798, and U.S. Pat. No. 6,227,534. In these devices, the front edge of the uppermost sheet is being lifted onto the slanted ramp by the separation roller by means of traction, whereby the front edge bends upwards and is separated from the second sheet that can eventually be selected. Since in this device, the uppermost sheet is pushed from the pile by means of traction, the uppermost sheet does not get loosened from the next one, the second sheet in the pile, so that the probability that the undesirable pick-up of the second sheet takes place is greater. The separation of the uppermost sheet from the second one is done essentially by bending the front edge upwards onto the slanted ramp, which hence should not rise too steeply. This upward bending is essentially depending on the angle of the upward gradient of the ramp and the properties of the sheet, and particularly on the stiffness of the sheet. That is why these devices are suitable only for a relatively narrow range of sheet qualities, or, respectively, need to be correspondingly adjusted to the different sheet qualities.

SUMMARY OF THE INVENTION

The object of the present invention is to create a method and a device for selecting the sheets of a record carrier from a pile, which are suitable for use with a high level of reliability with a wide range of sheet qualities and would allow high speed of the separation. According to the invention, this task can be solved by a method for selecting the sheets of a record carrier from a pile in order to feed them to an office machine or a printer, comprising the steps:

- subjecting the uppermost sheet of the pile to a rolling action, through which the uppermost sheet is loosened from the next sheet on the pile and is moved in the feeding direction,
- moving the uppermost sheet with its front edge against a stop, which is moved under an impingement angle of at least 90 degrees in relation to the flat plane and the direction, in which the uppermost sheet is being fed, and
- picking up the front edge of the uppermost sheet and lifting it away from the next sheet.

The stop can be moved essentially in the plane of its surface. The stop can be formed by at least one belt that is running upwards under the impingement angle. The stop can be formed by a slider that is moving upwards under the impingement angle. A dividing element can be moved between the lifted front edge of the uppermost sheet and the next sheet in the pile.

The object can furthermore be achieved by a device for selecting the sheets of a record carrier from a pile in order to feed them to an office machine or a printer, comprising a rolling action device that lies on the uppermost sheet of the pile and exerts a rolling action on the uppermost sheet in the feeding direction, a stop mounted before the front edge of the pile pointing in the feeding direction, wherein the front edge of the uppermost sheet is moved against the stop and wherein the stop can be moved upwards at an impingement angle of at least 90 degrees in relation to the flat plane and the direction in which the uppermost sheet is fed.

The pile stop can essentially move in the plane of its surface. The impingement angle can be between 90 and 100 degrees. The stop can be built of at least one belt, which runs upwards under the impingement angle. At least one belt can be a belt that can run endlessly and whose planar surface is turned towards the pile upwards and is running upwards under the impingement angle. The stop can be built with at least one slider, which can be moved upwards basically in a linear manner under the impingement angle. The slider may have at least one step, which picks up the front edge of the uppermost sheet. A sensor may detect the contact of the front edge of the sheet with the slider and may start the driving of the slider. A dividing element can be moved between the front edge of the uppermost sheet moving upwards at the stop and the front edge of the following second sheet. The at least one dividing element can be mounted before the front edge of the pile pointing towards the front edge of the pile that can be moved between the uppermost sheet and the following second sheet. The dividing element may intervenes by means of a finger between the uppermost sheet and the following second sheet and holds down the second sheet. A press-on roller can be mounted on the at least one dividing element, which presses the uppermost sheet against a driven pull-off roller when the dividing element between the uppermost sheet and the next sheet.

According to the invention, a rolling action is used for selecting the uppermost sheet of a record carrier in the form of a sheet. The uppermost sheet is loosened from the second sheet in the pile by means of a rolling action and is moved in the direction of feeding. In this way, the advantages of the separation through rolling are used, which consist mainly in its independence of the properties of the sheets and its reliability. The front edge of the uppermost sheet is moved against a stop that is placed in a steep position in relation to the flat plane where the front edge of the uppermost sheet is moved against this stop. By means of this steep angle it is achieved that the short feed path of the front edge of the uppermost sheet in the feeding direction of the rolling motion is transformed into a greater lifting path, which separates the front edge of the uppermost sheet from the front edge of the following second sheet. In the case when the upper sheets of the pile are fanned out in the form of scales by means of a rolling action, a minimal path difference is sufficient to push the uppermost sheet in relation to the following second sheet in order to separate the front edge of the uppermost sheet from the front edge of the second sheet and it to be captured by the stop, to be lifted from the second sheet, and to be selected for further transportation. Since only an extremely small path difference between the uppermost sheet and the second sheet by means of the rolling action needs to be generated, the separation can be performed with high speed.

In order to put this effect to use, the impingement angle of the stop in relation to the flat plane of the fed sheet should be at least 90 degrees. An impingement angle of more than 90 degrees, most advantageously about 100 degrees, or setting the stop in a slightly tilted position in relation to the pile, has the advantage that the front edge of the sheet will be maintained contiguous with the stop also when the front edge of the sheet moves upwards in a bow-shaped form.

In one version, the stop is built of belts, which are moving vertically upwards under the impingement angle in relation to the flat plane of the fed uppermost sheet. This version has the advantage that the front edge of the uppermost sheet that is fed under the effect of the rolling action is picked up upwards under traction, so that the lifting of the front edge of the uppermost sheet on the stop takes place faster.

In another version, the stop is built with at least one slider, which is being lifted in a linear way under the impingement angle and picks up the front edge of the uppermost sheet under traction through the intermediary of a step.

In the framework of this invention, the terms "moving upwards" or "upwards" denote always the direction that is perpendicular to the flat plane of the pile, also when the pile is not positioned horizontally.

In one advantageous version, a dividing element can be moved in the space gap formed between the front edge of the uppermost sheet and the front edge of the next sheet, and this element separates the uppermost sheet from the second sheet and holds down the second sheet during the transportation of the uppermost sheet. In this way, the selected uppermost sheet can be transported with higher speed of departure without running the danger that the back edge of the uppermost sheet, which is still lying onto the following second sheet, picks up this second sheet due to traction and/or electrostatic charge.

The rolling action device should preferably be positioned at the end of the pile that is away from the stop. In such a way, the rolling action device can begin with the rolling and the separation of the following second sheet before the previous sheet having been completely transported away from the pile. In this way, a faster separation cycle can be achieved.

BRIEF DESCRIPTION OF THE DRAWINGS

In the following text, the invention will be discussed in more details on the basis of the implementation examples shown in the figures.

DETAILED DESCRIPTION OF THE PREFERRED EMBODIMENTS

Figure 1:
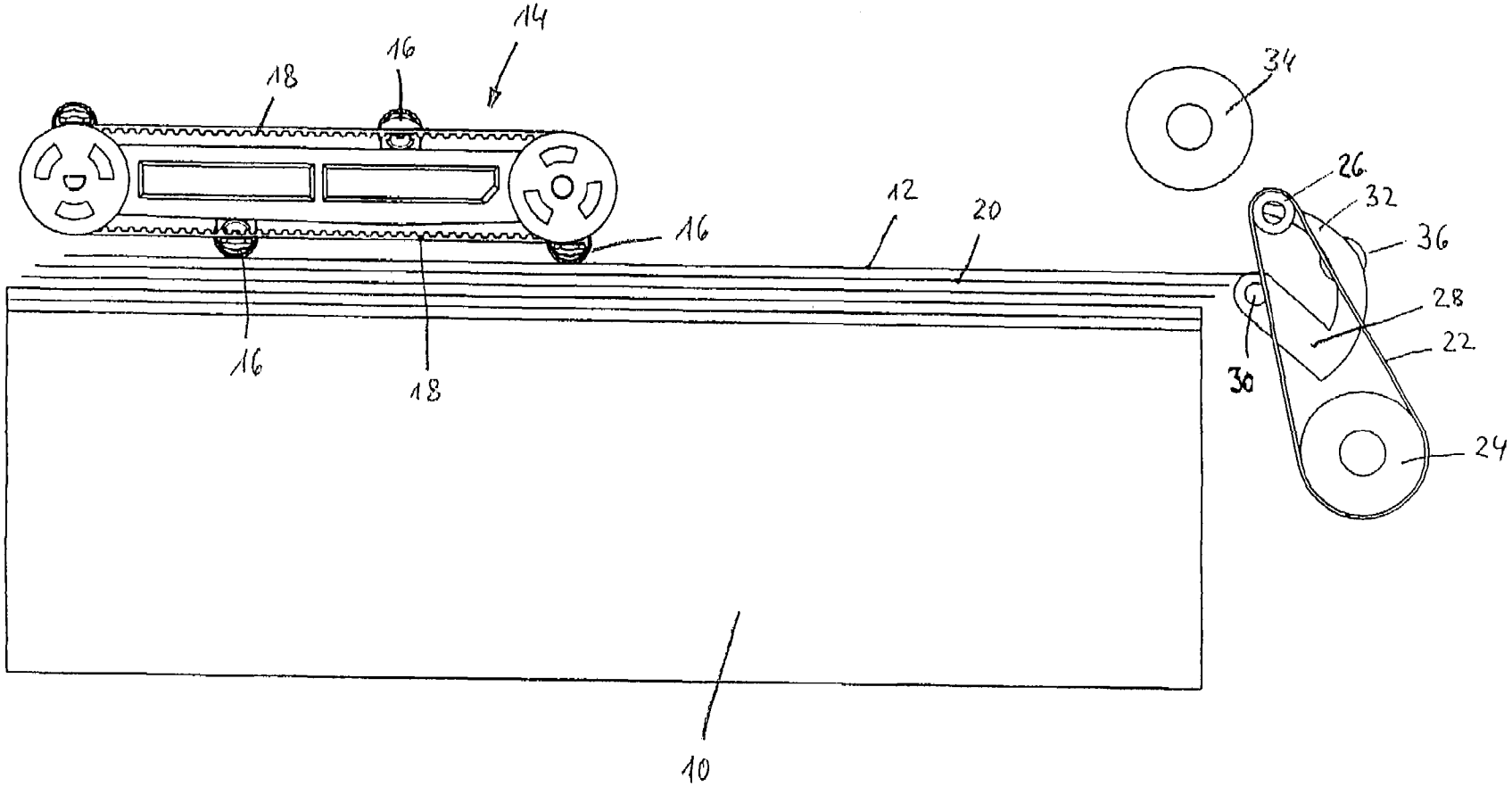
FIGS. 1 to 4 show a side view of a second implementation of the device according to the present invention in four consecutive steps of the separation process.

The record carriers in a sheet form, for example sheets of paper, that are being fed to an office machine, for example a printer or a copy machine, have been stacked in a pile 10 and kept there available. The pile 10 stands for instance on an elevating platform and is moved by means of this elevating platform in such a way that the upper edge of the pile 10 is always positioned at a predetermined height. In the representation in the figure, the uppermost sheet 12 is selected from the pile 10, picked up from the pile 10, and transported to the right where the uppermost sheet 12 is seized and transported to the office machine.

On the pile 10 there is a rolling action device 14, which corresponds to the rolling action device described, for instance, in DE 100 16 793 A1. This rolling action device 14 has rolling elements that are built as freely revolvable bearing housed turning rollers 16. These turning rollers 16 are embedded onto an endlessly running tractive device 18. The turning rollers 16 are moved in the feeding direction by the driven tractive device 18, or in the figure, to the right over the uppermost sheet 12 of the pile 10. While the turning rollers 16 run over the uppermost sheet 12, the turning rollers 16 exert vertical pressure on the pile 10. Since the turning rollers 16 are embedded as freely revolvable and have a slidable surface, the turning rollers 16 do not exercise a tractive action on the uppermost sheet. In this way, the uppermost sheet 12 and the next sheets on the pile 10 are rolled over by the turning rollers 16 that run under pressure over the uppermost sheet 12. The uppermost sheet 12 and—in gradually decreasing degree—the following sheets are deformed under the pressure of the turning rollers 16, whereby air can penetrate between the uppermost sheet 12 and the following second sheet 20 in the pile 10 so that the uppermost sheet 12 can get loosened from the following second sheet 20. The turning rollers 16 press with the pressure exerted by them on the uppermost sheet 12 so that a curvature is formed in the uppermost sheet 12 in front of the turning rollers 16. The continuously running turning rollers 16 push this curvature in front of themselves, whereby a feeding force is being exercised in direction to the right on the uppermost sheet 12 and in a decreasing degree on each of the following sheets in the pile 10. In this way, the upper sheets of the pile 10 are fanned out in the form of scales as this can be seen in FIG. 1. The uppermost sheet 12 is pushed farthest to the right, while the second sheet 20 and the following sheets are each pushed less and less far.

For the specialist it is obvious without further explanations that also other rolling action devices can be used instead of the shown rolling action device 14, which is known from DE 100 16 793 A1.

The sheets pushed from the pile 10 in the feeding direction by the rolling action device 14 (to the right in the figure) reach with their front edge in the feeding direction a stop, which is positioned crosswise in relation to the feeding direction of the sheet. The stop is positioned under a steep angle in relation to the flat plane of the uppermost sheet 12 that is being pushed forward. This impingement angle of the stop in relation to the flat plane and the feeding direction of the uppermost sheet 12 amounts to at least 90 degrees.

The stop in the case of the implementation example shown in FIGS. 1 to 4 consists of endlessly running belts 22, which rotate through a lower driven pulley 24 and an upper pulley 26. Several belts 22 are provided axially positioned at a distance from each other over the width of the front edge of the pile 10. The belts 22 are (in the figure) propellable in clockwise direction. The planar surface on the belts 22, which is running upwards and is turned towards the pile 10, represents the stop for the sheets of the pile 10. In the shown implementation example, this running upwards planar surface forms with the flat plane and the feeding direction of the fed uppermost sheet 12 an angle of about 100 degrees.

At least one dividing element 28 is inserted between the belts 22 positioned at a distance from each other in the direction of the front edge of the pile 10. The dividing element 28 has the form of a hook, which is embedded in a pivotal position around an axis that is parallel to the front edge of the pile 10. The free end of the dividing element 28 is formed as a finger 32, which points to the pile 10 and is built in the form of a circular arc in relation to the axis 30 as its center. The dividing element 28 is pivotable in the range of about 90 degrees counterclockwise between a neutral position shown in FIG. 1 and an intervention position shown in FIG. 4.

Over the front edge of the pile 10, a pull-off roller 34 drivable in counterclockwise direction is mounted whose axis runs parallel to the front edge of the pile 10. A freely rotatable press-on roller is mounted on the finger 32 of the dividing element. This roller comes in position by the pull-off roller 34 at the intervention position of the dividing element shown in FIG. 4.

The mode of functioning of the device is discussed on the basis of FIGS. 1 to 4.

FIG. 1 shows the device in off-position. The rolling action device 14, the belts 22, and the pull-off roller 34 are not driven on. The dividing element 28 is swayed to its off-position, in which the free tip of the finger 32 is situated on the side turned away from the pile 10 and behind the upwards-running planar surface of the belts 22. The upper sheets of the pile 10 are selected by the previous fanning out in the form of scales, whereby the uppermost sheet 12 is pushed farthermost to the right against the belts 22.

Figure 2:
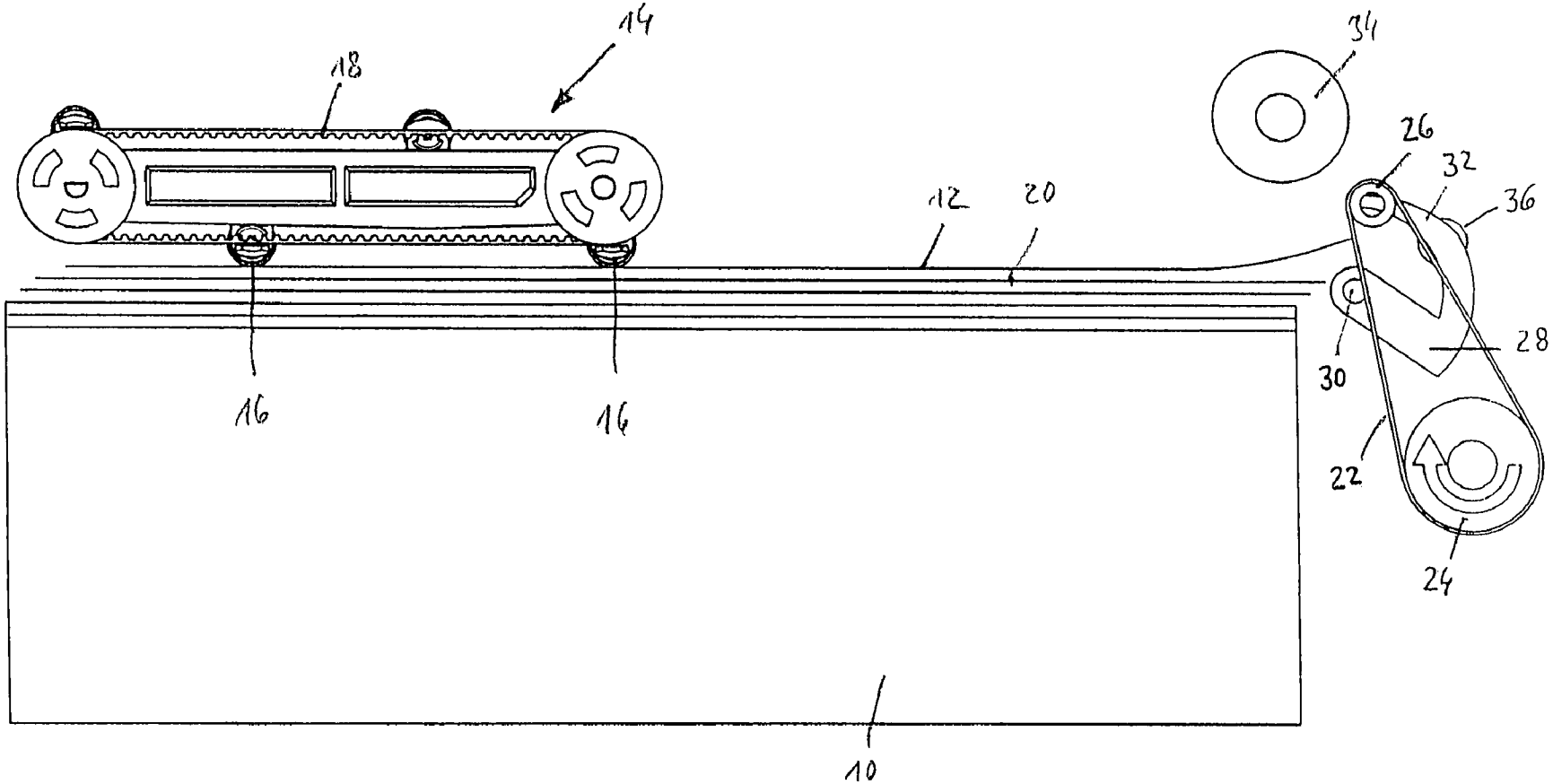
Figure 3:
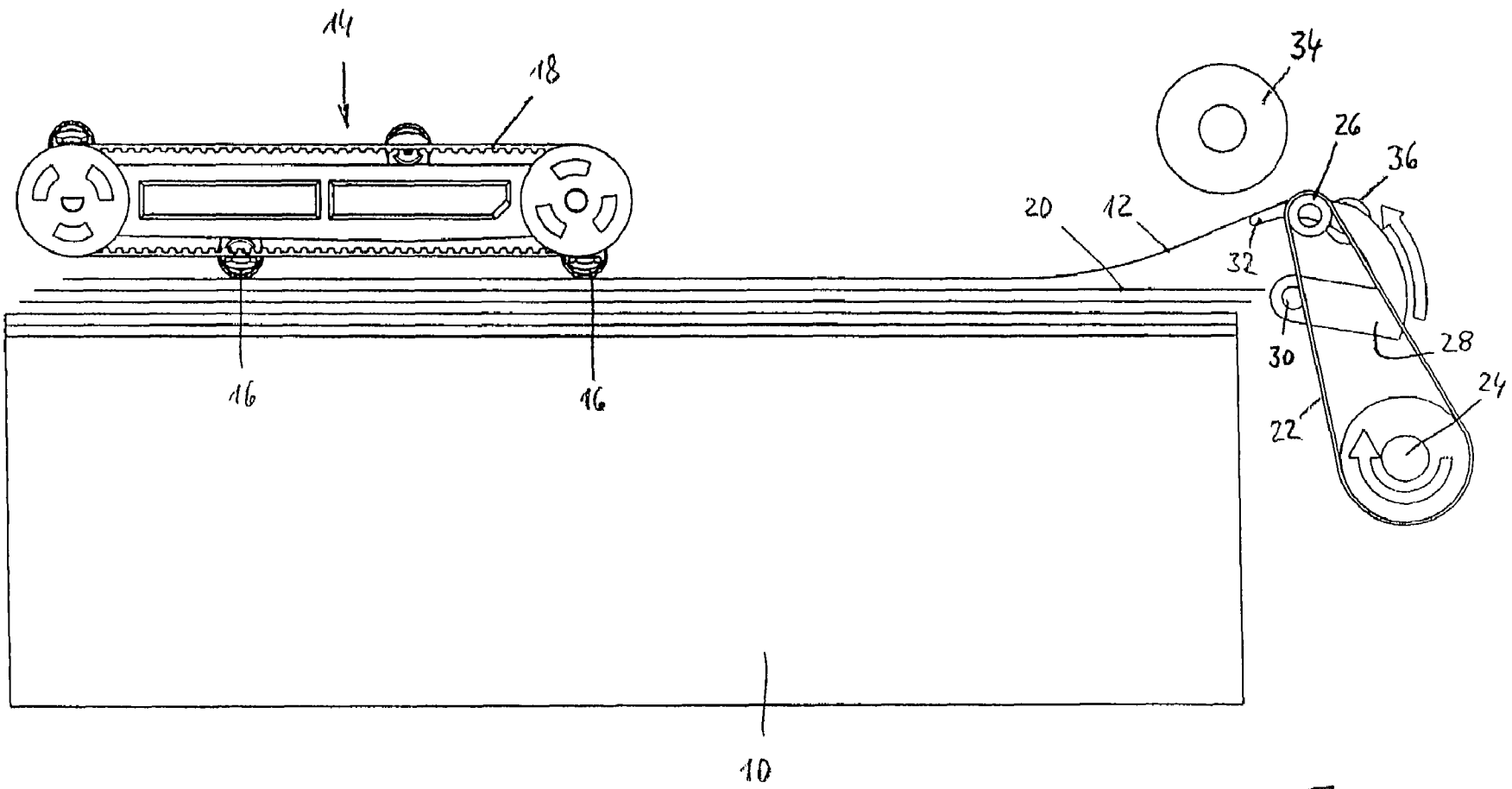

When a request signal comes from the office machine, the rolling action device 14, the belts 22, and the pull-off roller 34 are activated. The turning rollers 16, which lie on the uppermost sheet 12 of the pile 10, begin to move on the uppermost sheet 12 to the right in order to push this sheet to the right. In this way, the uppermost sheet 12 is pressed with its front edge against the upwards-running planar surface of the belts 22. As it is shown in FIG. 2, the belts 22 take up the front edge of the uppermost sheet 12, whereby this front edge of the uppermost sheet 12 is lifted from the front edge of the second sheet 20. Then a minimal feeding push on the uppermost sheet 12 by the rolling action device 14 is sufficient in order to press the front edge of the uppermost sheet 12 against the belts 22 and to lift the front edge of the uppermost sheet 12. This minimal feeding path can be performed very quickly. Thereby the front edge of the second sheet 20 does not yet come in position at the belts 22.

While the front edge of the uppermost sheet 12 is being lifted upwards by means of the belts 22, the dividing element 28 swivels in counterclockwise direction from its neutral position shown in FIGS. 1 and 2. In the position shown in FIG. 3, the front edge of the uppermost sheet 12 has reached the upper end of the upwards-running planar surface of the belts 22. During the swinging motion, the dividing element 28 arrives with the free tip of the finger under the front edge of the uppermost sheet 12 and therewith between the front edge of the uppermost sheet 12 and that of the second sheet 20.

Figure 4:
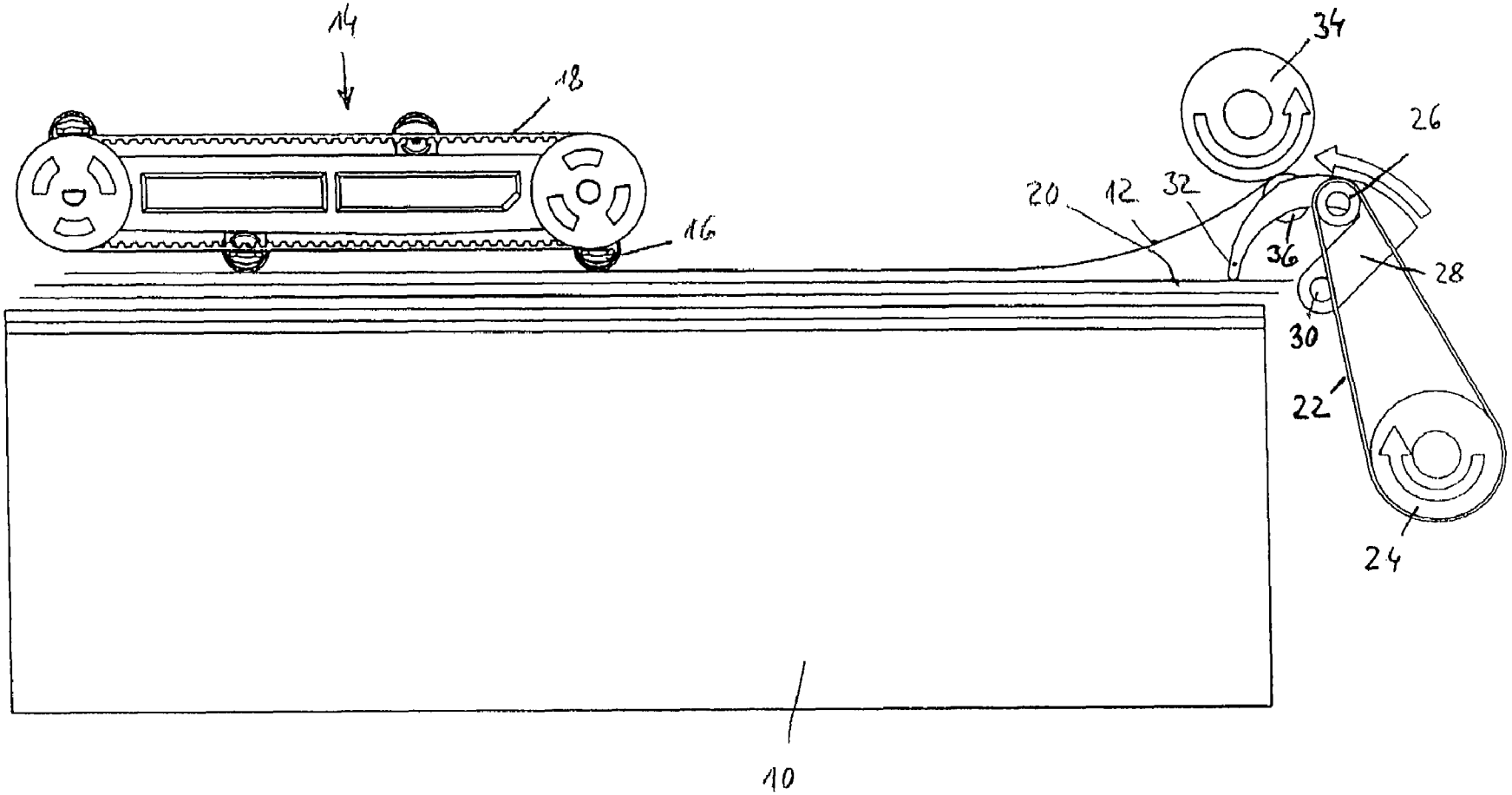

During the further swinging motion, the dividing element 28 reaches the position of the final grip shown in FIG. 4. The free tip of the finger 32 sits on the second sheet 20 and the press-on roller 36 arrives in position at the pull-off roller 34. Thereby the front edge of the uppermost sheet 12 is pressed against the driven pull-off roller 34 by the press-on roller 36 of the dividing element 28, so that uppermost sheet is grasped, taken out of the pile 10, and fed up into the office machine. Thereby the dividing element 28 holds firmly the second sheet on the pile 10, so that this second sheet 20 is not taken up under traction when the uppermost sheet 12 is being pulled out by the pull-off roller 34, whereby first the dangling end of the uppermost sheet 12 is still being pressed against the second sheet 20 by the rolling action device 14. Since the turning rollers 16 of the rolling action device 14 are embedded in such a way that can rotate freely, they do not obstruct pulling out of the uppermost sheet 12 by the pull-off roller 34. Alternatively, the rolling action device 14 can be lifted from the pile 10 immediately after the uppermost sheet 12 is grasped by the pull-off roller 34. Then for the next request, the rolling action device 14 can be lowered again onto the pile 10.

So far as the uppermost sheet 12 is pulled out, the dividing element 28 swivels again to its neutral position, as shown in FIG. 1, and the driving on of the rolling action device 14, the belts 22, and the pull-off roller 34 turned off until the next signal for request arrives and the separation cycle begins again.

It is easy to understand that the steep impingement angle of the upwards running planar surface of the belts 22, which forms the stop, has the consequence that only a very light push of the uppermost sheet 12 by the rolling action device 14 is sufficient to lift vertically the uppermost sheet 12 away from the second sheet 20 and to separate it completely and reliably from the second sheet 20. In such a way, this results in high separation speed combined with the reliable separation by means of the rolling action device that does not depend on the paper quality. Also when the front edge of the sheet 12 bends upwards on a path in the form of a circular arc, the front edge remains in contact with the belts 22 because their upwards-running planar surface is tipped over the pile 10.

Another form of implementation of the invention is shown in FIGS. 5 to 9. As far as this version conforms to the previous one, the same reference symbols are used and references are made to the preceding description.

In the implementation example shown in FIGS. 4 to 9, the stop is built by means of at least one slider 38. The slider, or, respectively, the sliders 38 are formed from flat bars whose plane extends in parallel to front edge of the pile 10. The slider 38 is mounted at an impingement angle of at least 90 degrees, or, preferably, about 100 degrees, in relation to the flat plane and the feeding direction of the uppermost sheet 12. At the upper end of at least one slider 38, one step 40 is built, which is facing the pile 10 and on which the front edge of the fed uppermost sheet 12 can position itself.

The at least one slider 38 can be shifted in the direction of its length, i.e. in the direction of its impingement angle. Hereby for this purpose at the bottom of the slider 38 and at the side facing the pile 10, a gear rack 42 is built, into which a gear sprocket 46 driven by a stepping motor 44 gets engaged. A tension spring 48 holds the slider 38 contiguous onto a leading bar 50 and with that also the gear rack 42 with the engaged gear sprocket 46. In front of the gear sprocket 46, a leading roller 52 is mounted, so that the slider 38 could be linearly moved when driven by the sprocket 46 between the leading bar 50 and the leading roller 52. At the bottom end of the slider 38, a banner 54 is mounted, which operates in conjunction with a sensor 56 that can, for instance, be built as a light barrier.

Compared to the implementation example shown in FIGS. 1 to 4, the dividing element 28 is slightly modified. In FIGS. 5 to 9, the movement in the form of a circular arc of the finger 32 of the dividing element 28 is modified in such a way that the finger 32 is moved along a circular arc by an arm 60 driven in a swinging manner by a stepping motor 58. Thereby the finger 32 is lead by the pin 62.

The operation of the device in the second implementation example is discussed on the basis of FIGS. 5 to 9.

Figure 5:
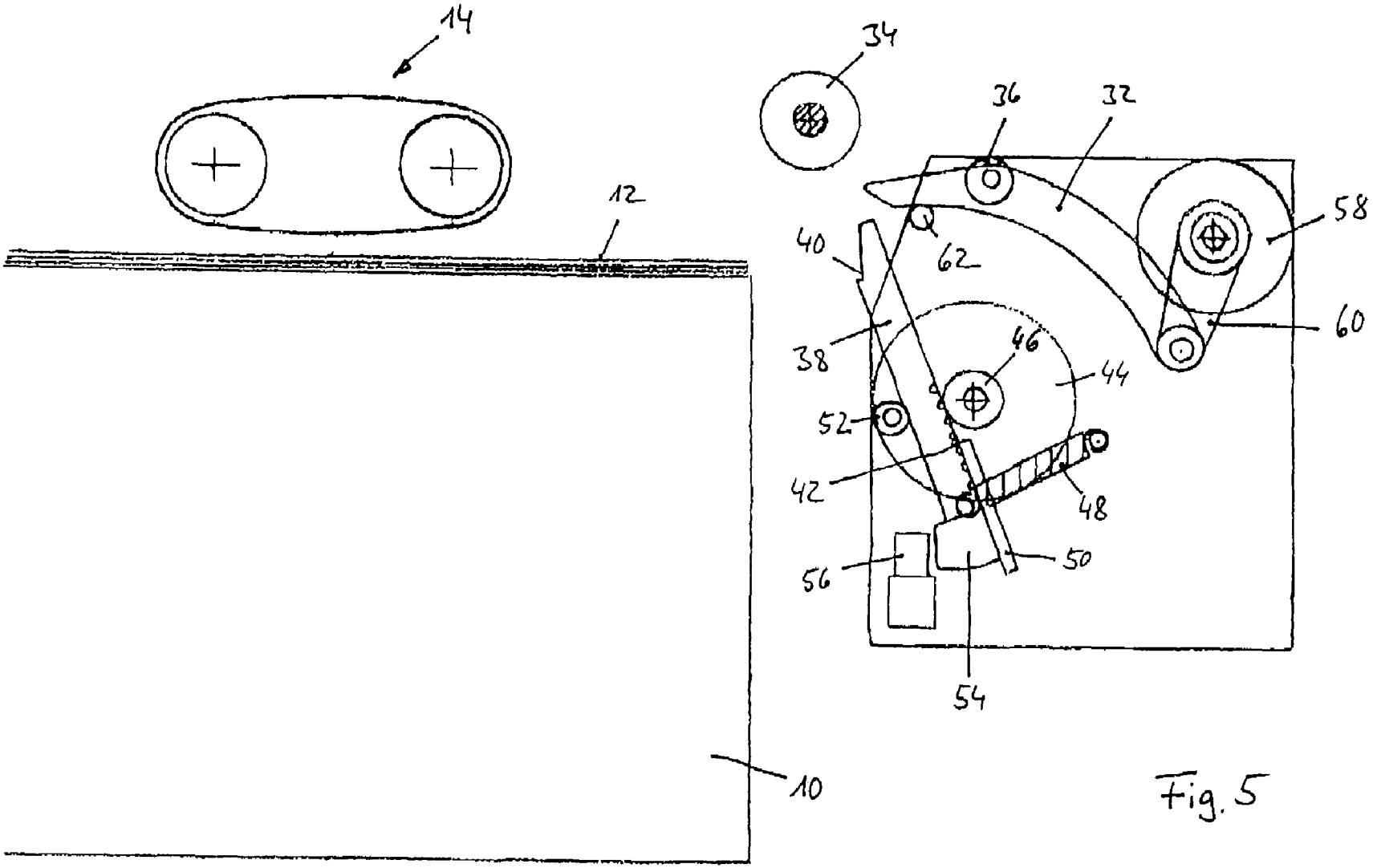
FIGS. 5 to 9 show a side view of one first implementation of the device according to the present invention in five consecutive steps of the separation process.

In FIG. 5, the device is in off position. The rolling action device 14, which in FIGS. 5 to 9 is represented only schematically, is lifted from the pile 10. The at least one slider is in its bottom end position, whereby the tension spring 48 holds the slider 38 contiguous onto the leading bar 50. In this way, the banner 54 is swayed away from the sensor 56. The dividing element 28 is in its withdrawn position.

Figure 6:
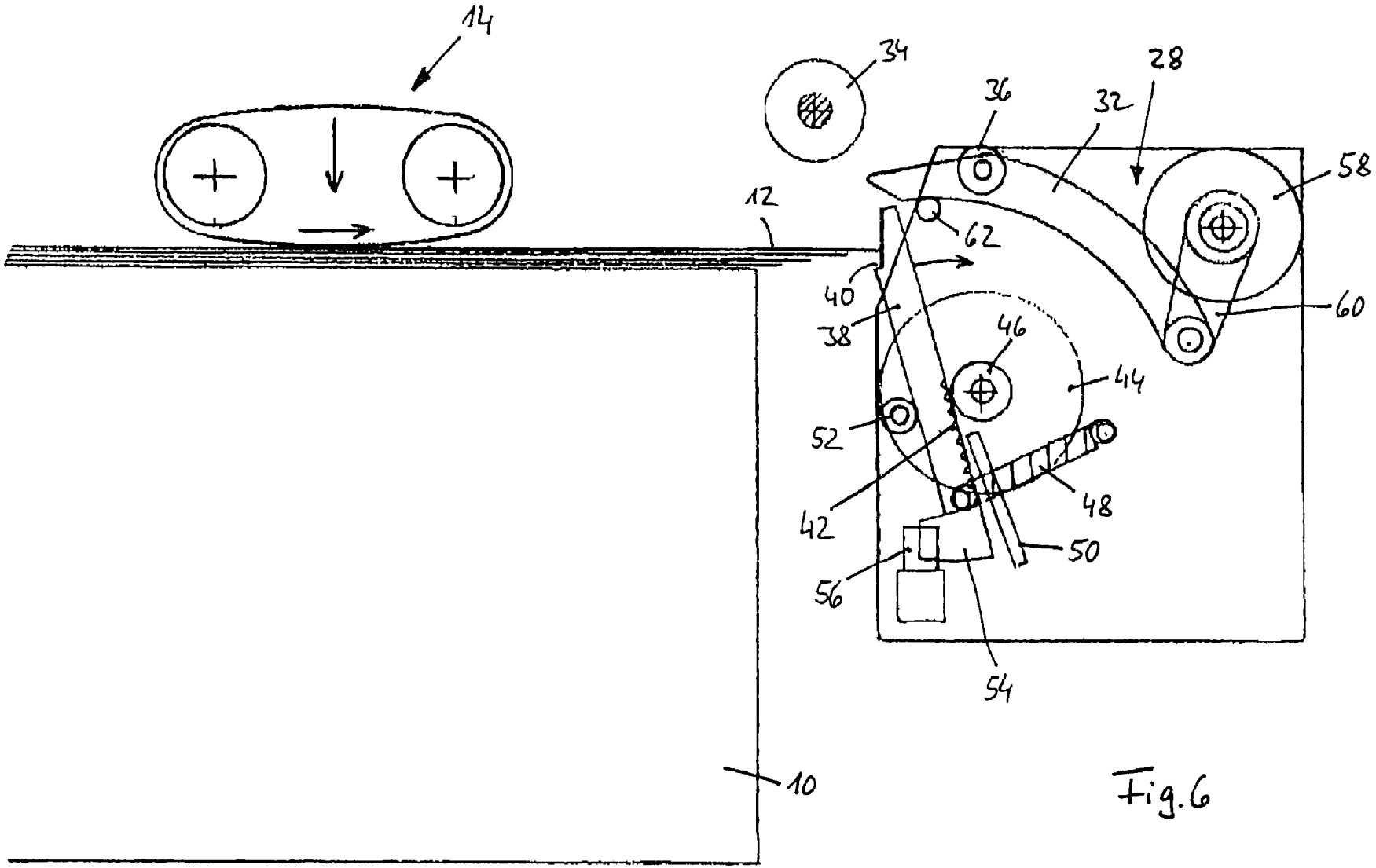

When the device receives a signal requesting a sheet, the rolling action device 14 is lowered onto the pile, as this is shown in FIG. 6. At the same time, the rolling action device 14 is driven in such a way that it pushes forward the upper sheets of the pile 10 in the form of scales. Thereby the uppermost sheet 12 of the pile 10 is pushed forward farther than the next sheet and is pushed with its front edge against the upper end of the at least one slider 38. The uppermost sheet 12 swings thereby the slider 38 against the force of the tension spring 48, as this is shown in FIG. 6 with an arrow. The slider 38 is maintained swingable between gear sprocket 46 and the leading roller 52. With the swinging of the slider 38, its lower end is lifted, and the banner 54 comes in the area of the sensor 56 whereby, for instance, the light barrier of the sensor 56 is interrupted.

Figure 7:
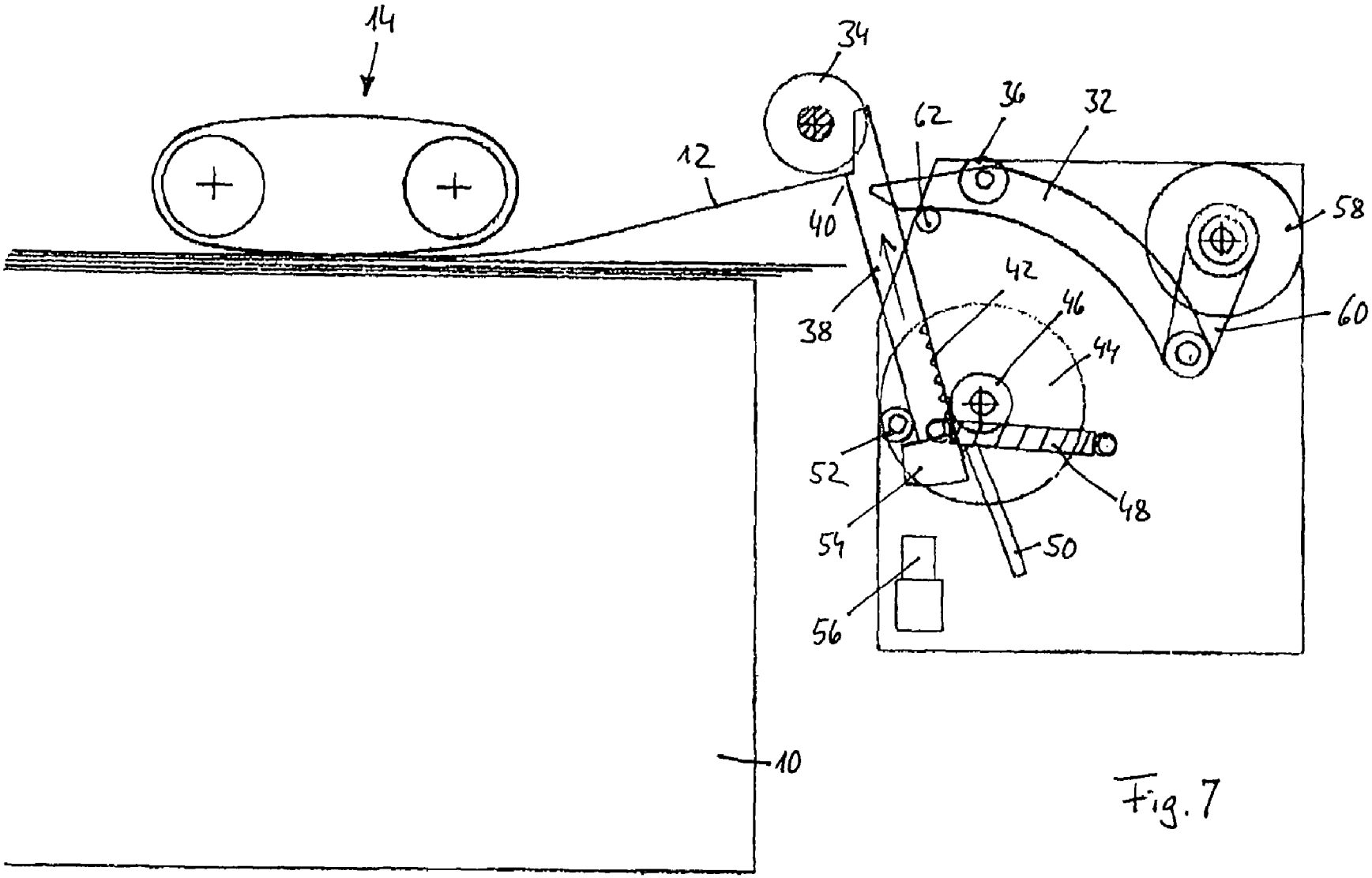

The signal of the sensor 56 obtained in this way then starts the stepping motor 44, so that the gear sprocket 46 in the figure is driven in clockwise direction and pushes thereby the slider 38 upwards, as this is shown in FIG. 7 with an arrow. Thereby the at least one slider 38 picks with its step 40 the uppermost sheet 12 and lifts it from the next sheet of the pile 10.

Figure 8:
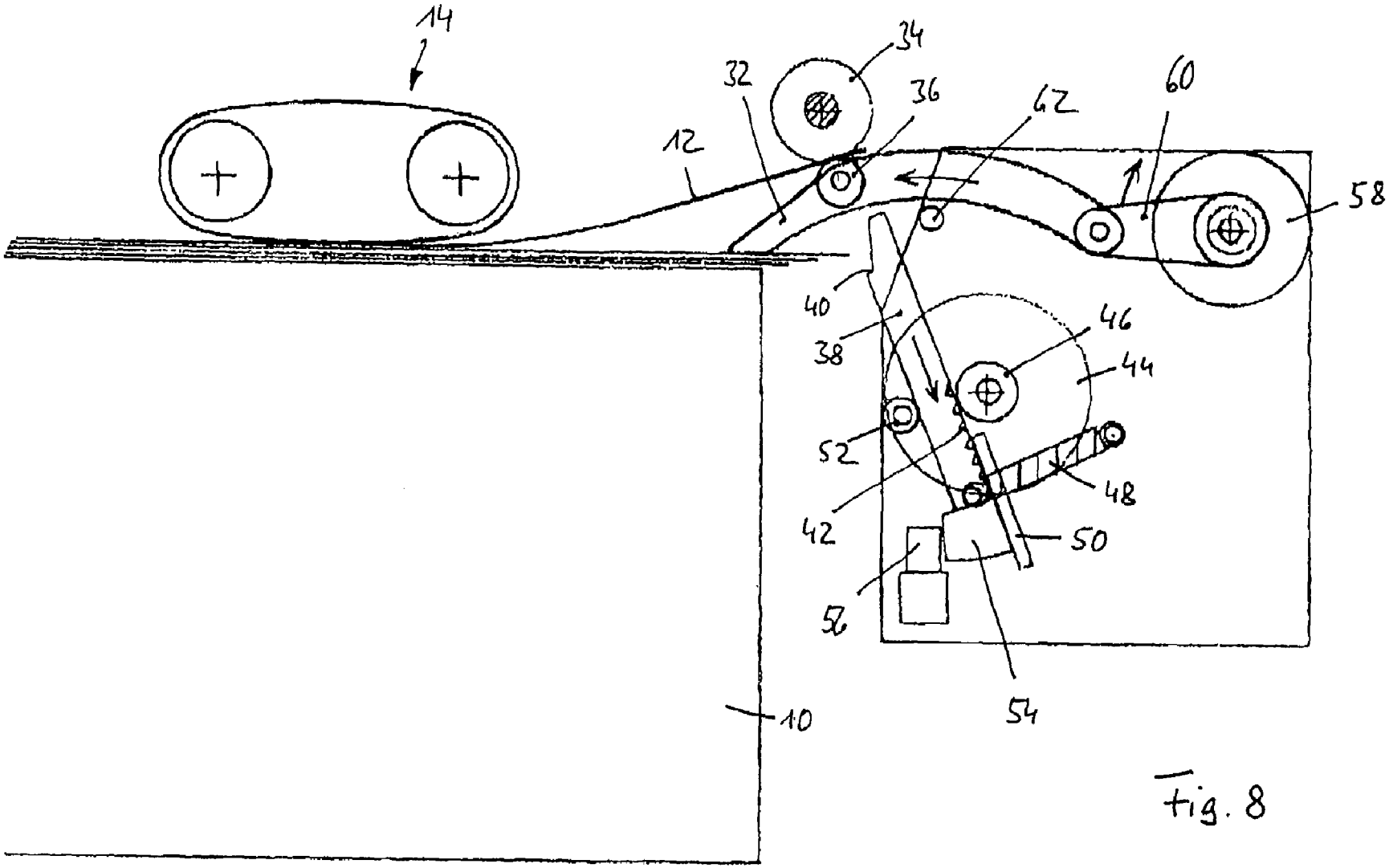

The start signal of the sensor 56 controls also the stepping motor 58 and puts it in operation mode. The stepping motor 58 swings the arm 60 in clockwise direction, as it is shown in FIG. 8 with an arrow. In this way, the finger 32 is pushed in the direction shown by the arrow, so that it intervenes just between the lifted front edge of the uppermost sheet 12 and the front edge of the next sheet. The free end of the finger 32 positions itself onto the front edge of the second sheet and holds it firmly. The press-on roller 36 of the dividing element 28 brings then the front edge of the uppermost sheet 12 to a traction attachment to the pull-off roller 34, so that the uppermost sheet 12 is picked up and is fed to the office machine. The stepping motor 44 begins turning, so that the gear sprocket 46 moves the slider 38 downwards to its initial position.

Figure 9:
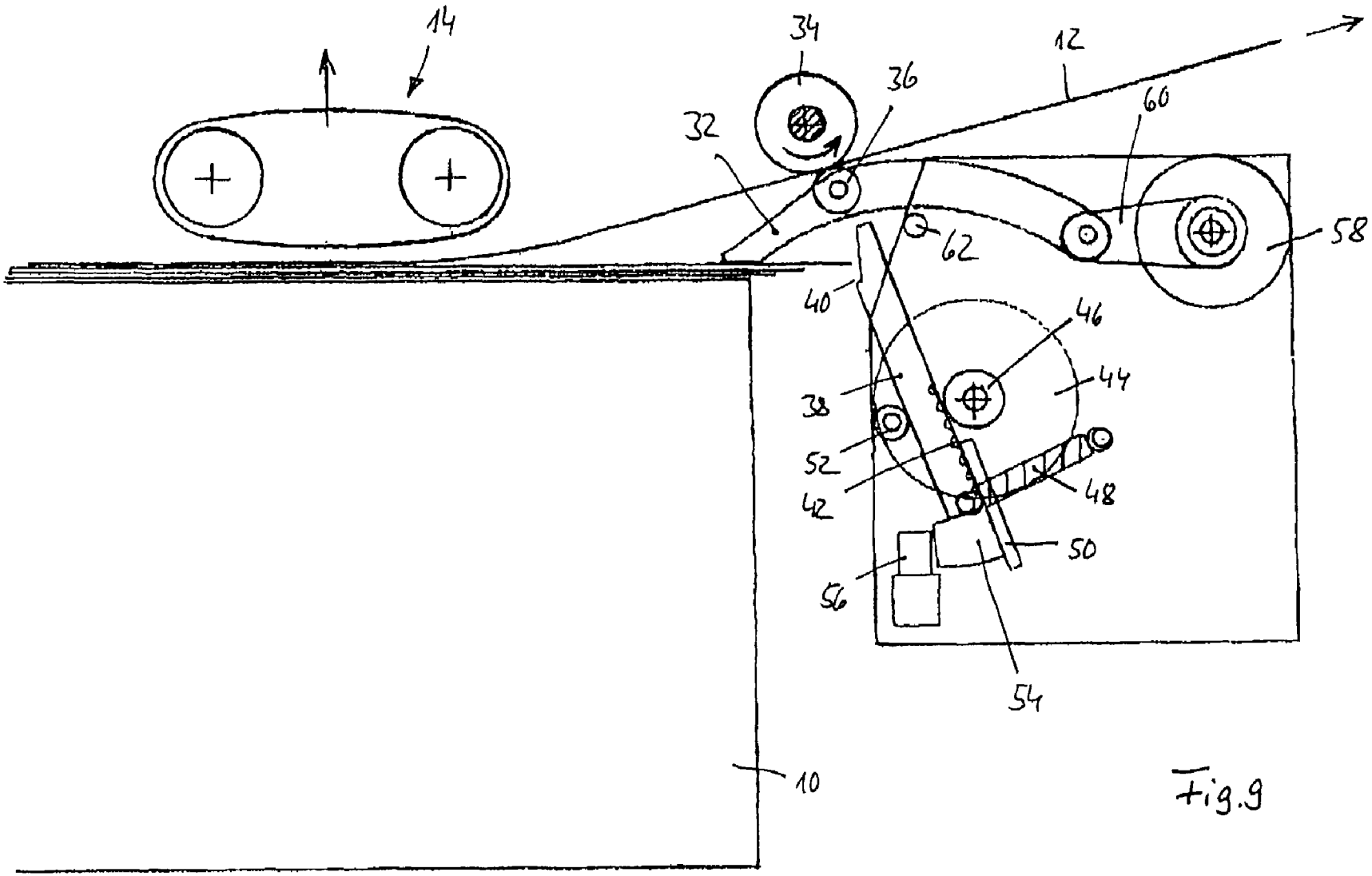

FIG. 9 shows the pull-off process. The rolling action device 14 is lifted from the pile so that the uppermost sheet 12 is free. The pull-off roller 34 pulls out the uppermost sheet 12 from the pile 10 and feeds it into the office machine. The following second sheet of the pile is held firmly by the finger 32 of the dividing element 28, so that it could not be picked up by the uppermost sheet 12 that is being pulled out. The at least one slider 38 is again brought back into its neutral position. As far as the uppermost sheet 12 is pulled out and has been picked up by the office machine, the stepping motor 58 also turns in the opposite direction so that it could return the dividing element 28 again in its initial position. Then at this point, the device is again in its initial position, as shown in FIG. 5, and is ready for the next request for a sheet.

We claim:

1. A method for selecting the sheets of a record carrier from a pile in order to feed them to an office machine or a printer, comprising the steps:

subjecting the uppermost sheet of the pile to a rolling action, through which the uppermost sheet is loosened from the next sheet on the pile and is moved in the feeding direction, moving the uppermost sheet with its front edge against a stop, which is moved under an impingement angle of more than 90 degrees in relation to a flat plane and a direction, in which the uppermost sheet is being fed, and picking up the front edge of the uppermost sheet and lifting it away from the next sheet.

2. The method according to claim 1, wherein the stop is moved essentially in the plane of its surface.

3. The method according to claim 2, wherein the stop is formed by at least one belt that is running upwards under the impingement angle.

4. The method according to claim 1, wherein a dividing element is moved between the lifted front edge of the uppermost sheet and the next sheet in the pile.

5. A device for selecting sheets of a record carrier from a pile in order to feed them to an office machine or a printer, comprising a rolling action device that lies on the uppermost sheet of the pile and exerts a rolling action on the uppermost sheet in a feeding direction, a stop mounted before the front edge of the pile pointing in the feeding direction, wherein the front edge of the uppermost sheet is moved against the stop and wherein the stop can be moved upwards at an impingement angle of more than 90 degrees in relation to a flat plane and a direction in which the uppermost sheet is fed.

6. The device according to claim 5, wherein the pile stop can essentially move in the plane of its surface.

7. The device according to claim 6, wherein the impingement angle is between 90 and 100 degrees.

8. The device according to claim 5, wherein the stop is built of at least one belt, which runs upwards under the impingement angle.

9. The device according to claim 8, wherein at least one belt is a belt that can run endlessly and whose planar surface is turned towards the pile upwards and is running upwards under the impingement angle.

10. The device according to claim 5, wherein a dividing element can be moved between the front edge of the uppermost sheet moving upwards at the stop and the front edge of the following second sheet.

11. The device according to claim 10, wherein the at least one dividing element is mounted before the front edge of the pile pointing towards the front edge of the pile that can be moved between the uppermost sheet and the following second sheet.

12. The device according to claim 11, wherein the dividing element intervenes by means of a finger between the uppermost sheet and the following second sheet and holds down the second sheet.

13. A device for selecting sheets of a record carrier from a pile in order to feed them to an office machine or a printer, comprising a rolling action device that lies on the uppermost sheet of the pile and exerts a rolling action on the uppermost sheet in a feeding direction, a stop mounted before the front edge of the pile pointing in the feeding direction, wherein the front edge of the uppermost sheet is moved against the stop and wherein the stop can be moved upwards at an impingement angle of more than 90 degrees in relation to a flat plane and a direction in which the uppermost sheet is fed, wherein a dividing element can be moved between the front edge of the uppermost sheet moving upwards at the stop and the front edge of the following second sheet, wherein the at least one dividing element is mounted before the front edge of the pile pointing towards the front edge of the pile that can be moved between the uppermost sheet and the following second sheet, wherein a press-on roller is mounted on the at least one dividing element, which presses the uppermost sheet against a driven pull-off roller when the dividing element between the uppermost sheet and the next sheet.

* * * * *